US006799372B2

(12) United States Patent
Kaimi et al.

(10) Patent No.: US 6,799,372 B2
(45) Date of Patent: Oct. 5, 2004

(54) METHOD FOR MANUFACTURING HYDRO DYNAMIC BEARING DEVICE

(75) Inventors: Masayuki Kaimi, Kuwana (JP); Hidekazu Hirano, Iwata (JP); Norimasa Marui, Iwata (JP); Kuniharu Kokubu, Kuwana (JP)

(73) Assignee: NTN Corporation, Osaka-Fu (JP)

( * ) Notice: Subject to any disclaimer, the term of this patent is extended or adjusted under 35 U.S.C. 154(b) by 0 days.

(21) Appl. No.: 10/406,837

(22) Filed: Apr. 4, 2003

(65) Prior Publication Data

US 2003/0213128 A1 Nov. 20, 2003

(30) Foreign Application Priority Data

Apr. 15, 2002 (JP) ..... 2002-112083

(51) Int. Cl.[7] ..... B21K 1/10

(52) U.S. Cl. ..... 29/898.02; 29/898.041; 451/406; 82/162

(58) Field of Search ..... 29/898.02, 898.041; 451/397, 402, 367, 406, 408, 413, 918; 82/148, 162

(56) References Cited

U.S. PATENT DOCUMENTS 3,581,611 A * 6/1971 Lentz ..... 82/148
4,195,448 A * 4/1980 Check et al. ..... 451/5
6,431,954 B1 * 8/2002 Junker ..... 451/11

FOREIGN PATENT DOCUMENTS

JP 10-193202 * 7/1998

* cited by examiner

*Primary Examiner*—Eric Compton
(74) *Attorney, Agent, or Firm*—J.C. Patents

(57) ABSTRACT

A method for manufacturing a hydro dynamic bearing device is provided. This method is capable of sufficiently increasing a circumferential speed at the time of grinding an axial member which is a structural component of the hydro dynamic bearing device, and also capable of preventing the generation of centrifugal whirling to improve the grinding efficiency and working efficiency while improving the quality of the product. The axial member as one of structural component of the hydro dynamic bearing device is supported at both ends thereof with a pair of plate members in a face-contact manner, while rotating the axial member around its axial center. The outer peripheral surface of the axial part of the axial member is ground on a grindstone while supporting the outer peripheral surface of the axial part with a supporting member. Also, the plate member contacting with the flange part of the axial member in a face-contact manner has at least a roll-off part formed in a predetermined area of the rotational center of the contact surface thereof. Furthermore, the contact part of the plate member to the flange part is elastically supported by a elastic member.

16 Claims, 11 Drawing Sheets

METHOD FOR MANUFACTURING HYDRO DYNAMIC BEARING DEVICE

BACKGROUND OF THE INVENTION

1. Field of the Invention

The present invention relates to a method for manufacturing a hydro dynamic bearing device. In particular, the present invention relates to a method for manufacturing a hydro dynamic bearing device to be used in a spindle motor equipped in an information technology device such as a magnetic disk device (e.g., HDD or FDD), an optical disk device (e.g., CD-ROM, CD-R/RW, or DVD-ROM/RAM), and an optical magnetic disk device (e.g., MD or MO), a scanner motor equipped in a copying machine, a laser printer (LBP), a barcode reader, or the like, or a small-sized motor equipped in an electrical equipment such as an axial fan.

2. Description of the Related Art

As is generally known in the art, each kind of the motors listed above have been promoted to be provided at lower cost, driven at higher speed and more quiet, and so on in addition to attain a high rotational accuracy. As one of factors that define these required performances, a bearing supporting spindle of the motor has been increasingly valued. In recent years, therefore, as such a kind of the bearing, the use of a hydro dynamic bearing device having excellent characteristics that serve a request for the above performance has been studied, and such a hydro dynamic bearing device has been developed in a quest to put it to practical use.

For instance, a hydro dynamic bearing device to be built in a spindle motor of a disk device such as a hard disk drive (HDD) comprises a radial bearing part for rotatably retaining an axial member in a non-contact manner in the radial direction and a thrust bearing part rotatably retaining the axial member in a non-contact manner in the thrust direction. As a bearing part of each of them, a hydro dynamic bearing device having a groove (a hydro dynamic pressure generating groove) for the generation of hydro dynamic pressure on its bearing surface is used.

In this case, the hydro dynamic pressure generating groove of the radial bearing part is formed in the inner peripheral surface of the bearing member or the housing, or formed in the outer peripheral surface of the axial member. On the other hand, in the case of using an axial member having a flange part, the hydro dynamic pressure generating groove of the thrust bearing part is formed in each of the opposite end faces of the flange part or the surface (e.g., the end face of the bearing member or the bottom surface of the housing) facing to such an end face.

In such a kind of the spindle motor, furthermore, a higher rotational accuracy has been desired in recent years for attaining an increase in information-recording density and an increase in rotation speed of the motor. For addressing such a request, a higher rotational accuracy of the hydro dynamic bearing device to be built in the spindle motor has also been desired.

To improve the rotational accuracy of the hydro dynamic bearing device, it is important to adjust the radial bearing clearance and the thrust bearing clearance in which hydro dynamic pressures are generated. For properly adjusting the clearance, there is a need to work upon the structural component of the hydro dynamic bearing device related to each bearing clearance, especially the axial member that forms each axial bearing with the axial member. Therefore, the required grinding is performed as a finish machining on the part where each bearing clearance of the axial member is formed at the time of processing or manufacturing the axial member.

More concretely, as shown in FIG. 10, the axial member 2 is comprised of an axial part 2*a* and a flange part 2*b*, which are molded in one piece. A bearing member (not shown) is arranged on the outer peripheral side of the axial member 2. In addition, a radial bearing clearance is formed between the outer peripheral surface of the axial part 2*a* and the bearing member. Furthermore, a thrust bearing clearance is formed between the distal end face 2*b*1 of the flange part 2*b* (the end face on the near side to the axial part 2*a*) and the bearing member, and also another thrust bearing clearance is formed between the proximal end face 2*b*2 of the flange part 2*b* (the end Face on the far side from the axial part 2*a*) and the inner bottom face of the housing (not shown).

In this case, in the process of manufacturing the axial member 2, the outer peripheral surface of the axial part 2*a*, which forms the radial bearing clearance with the bearing member, is subjected to grinding. For grinding the outer peripheral surface, heretofore, the following exemplified method has been generally applied.

As shown in FIG. 11, the conventional method comprises the steps of perforating the center of the distal end face 2*a*4 of the axial part 2*a* formed on the axial member 2 and the center of the proximal end face 2*b*2 of the flange part in the axial member with center holes 2*bc*, respectively, and fitting a pair of tapered centering members 41 into the center holes 2*bc*, respectively, to sandwich the axial member 2 with the centering members 41.

Under such a condition, the grinding is performed by imparting an axial rotary motion from the centering member 41 to the axial member 2, while pressing a grindstone 43 on the outer peripheral surface.

However, when the grinding is performed while supporting the axial member from its opposite ends with the respective centering members 41, there is a possibility of causing a decrease in not only a grinding efficiency but also a work efficiency because of the following reasons. That is, the circumferential speed of the axial member 2 is hardly increased in a sufficient manner at the time of the rotary motion of the axial member 2 (e.g., it is limited to about 100 rpm) due to the facts, for example the contact area between the centering member 41 and the center hole 2*bc* is small.

In the grinding with such a center support, the axial member may cause centrifugal whirling while rotating when the center position is deviated. As a result, the quality of the axial member may decrease as the outer peripheral surface of the axial part of the axial member may be ground in a slanting direction, or the roundness of the axial member may deviate from the desired level.

BRIEF SUMMARY OF THE INVENTION

The present invention has been completed in consideration of the above circumstances. A technical object of the present invention is to provide a method for manufacturing a hydro dynamic bearing device capable of sufficiently increasing a circumferential speed of an axial member in the step of grinding the axial member and capable of preventing the generation of centrifugal whirling of the axial member to increase the grinding efficiency and the working efficiency in addition to improve the quality of the resulting product.

In the present invention, for attaining the above technical object, there is provided a method for manufacturing a hydro dynamic bearing device including an axial member having a flange part on one end of an axial part thereof a radial bearing part that support the axial part in a non-contact manner in a radial direction by a hydro dynamic pressure action of a fluid generated in a radial bearing clearance, and a thrust bearing part that supports the flange part in a non-contact manner in a thrust direction by a hydro dynamic pressure action of a fluid generated in a thrust bearing clearance. The method includes, the steps of: supporting the axial member at both ends of the axial member in an axial direction thereof with a pair of plate members in a face-contact manner, rotating the axial member around its axial center, and grinding an outer peripheral surface of the axial part of the axial member on a grindstone while supporting the outer peripheral surface of the axial part with a supporting member.

Here, the phrase "supporting the axial member at both ends of the axial member with a pair of plate members in a face-contact manner" means that the proximal end face of the flange part of the axial member (i.e., the end face of the flange part on the far side from the axial part) is supported by one of the plate members such as a backing plate in a face-contact manner and the distal end face of the axial part of the axial member is supported by the other of the plate members such as a pressure plate in a face-contact manner to sandwich the axial member between the plate members with their appropriate holding powers.

According to such a configuration of the method, the opposite end faces of the axial member is supported by a pair of the plate member in a face-contact manner, so that the contact area between each end face and the corresponding plate member becomes wide compared with that of the conventional center-supporting method and the slip between the end face and the corresponding plate member hardly occurs, resulting in a preferable contact state for obtaining a larger holding power. Therefore, in the case of imparting the axial member a rotary motion around the axle center thereof, the circumferential speed of the axial member can be sufficiently increased, resulting in the improvements of grinding efficiency and working efficiency. Furthermore, the opposite ends of the axial member are supported in a face-contact manner instead of being supported by means of the center support as that of the conventional one. Therefore, the generation of centrifugal whirling hardly occurs at the time of the rotation of the axial member, so that it will be advantageous for grinding the outer peripheral surface of the axial part with high precision. Here, the supporting member for supporting the outer peripheral surface of the axial part of the axial member may be placed almost on the middle of the axial member in the axial direction. In this case, it is advantageous to perform grinding in the form of pressing a grindstone on the whole length of the outer peripheral surface of the axial part in the axial direction. In addition, the number of the supporting members is not specifically limited. Preferably, however, one or two supporting members may be placed in their respective positions facing to the grindstone (i.e., the positions that receive the pressures from the grindstone).

In this case, the plate member to be face contact with the flange part of the axial member (i.e., the end face of the flange part on the far side from the axial part) may preferably includes a roll-off part on a predetermined area defined in a rotational center of the contact surface. That is, when the step of cutting the end face of the axial member is performed prior to the step of grinding, the circumferential speed of the outer peripheral part of the end face of the axial member is relatively high at the time of a rotary motion of the axial member. Therefore, an appropriate cutting can be performed using a cutting tool. In this case, on the other hand, the circumferential speed of the rotational center of the end face is relatively low, so that a sufficient cutting cannot be performed. After completing the cutting, there is caused an undesired protruded part in the vicinity of the rotational center of the end face of the axial member (particularly, the end face of the flange part). In order to avoid such a disadvantage, as described above, at least a predetermined area defined in the rotational center of the plate member to be face contact with the end face of the flange part may be provided with a roll-off part to prevent the protruded part formed on the end face from contacting with the plate member at the time of cutting, securing an appropriate state of face contact.

It is preferable that the outer diameter d of the contact surface of the plate member to be face contact with the flange part is defined so as to be smaller than the outer diameter D of the flange part. Such a configuration allows the contact surface to be hardly slipped while the difference with a supporting state of the end face on the axial part side because of an increase in the holding pressure per unit area acting on the contact surface, compared with the case in which the contact surface of the plate member is set to an almost similar size to the flange diameter of the contact surface of the plate member. Consequently, the axial member can be supported from its opposite ends with a good balance and a good stability.

In the above configuration of the device, preferably, the contacting part of the above plate member to the flange part may be elastically supported by an elastic member. In this case, the contacting part of the plate member to the flange part may be preferably comprised of, for example, a metallic plate or the like having a high rigidity. In this way, an appropriate elastic deformation of the elastic member allows the contacting part of the plate member to be brought into contact with the flange part all over the contacting part without any clearance between them in a face-contact manner. As the state of face-contacting support to the flange part is stabilized, it becomes possible to grind the outer peripheral surface of the axial part with high precision.

In addition, the supporting member may preferably support two thirds or more of the outer peripheral surface of the axial member in the direction of the axle center thereof Therefore, the press force from a grindstone is uniformly received by the supporting member over a wide range in the direction of the axle center, so that it becomes possible to grind the outer peripheral surface with high precision without letting the axial part of the axial member rattle or oscillate.

In this case, as described above, in addition to the step of grinding the outer peripheral surface, when the additional step of grinding one end face of the flange part on the axial part side and the other end face of the flange part on the far side from the axial part, the end face on the far side from the axial part may preferably be ground in advance of grinding the end face on the axial part side. Consequently, the end face of the flange pan on the far side from the axial part is ground with high precision at first, and then the finished end face is supported by the supporting member while grinding the other end face of the flange part on the axial part side, so that both end faces of the flange part can be ground with high precision. On the other hand, when the end face of the flange part on the axial part side is ground at first, the end face of the flange part on the axial part side cannot be effectively used even though such an end surface has finished with high precision by the grinding because the finished end face is not involved in the step of grinding the end face of the flange part on the far side from the axial part. Consequently, as described above, when the end face of the flange part on the far side from the axial part is ground first the ground end face can be effectively used, resulting an appropriate sequence of grinding operations.

DETAILED DESCRIPTION OF THE INVENTION

Figure 8:
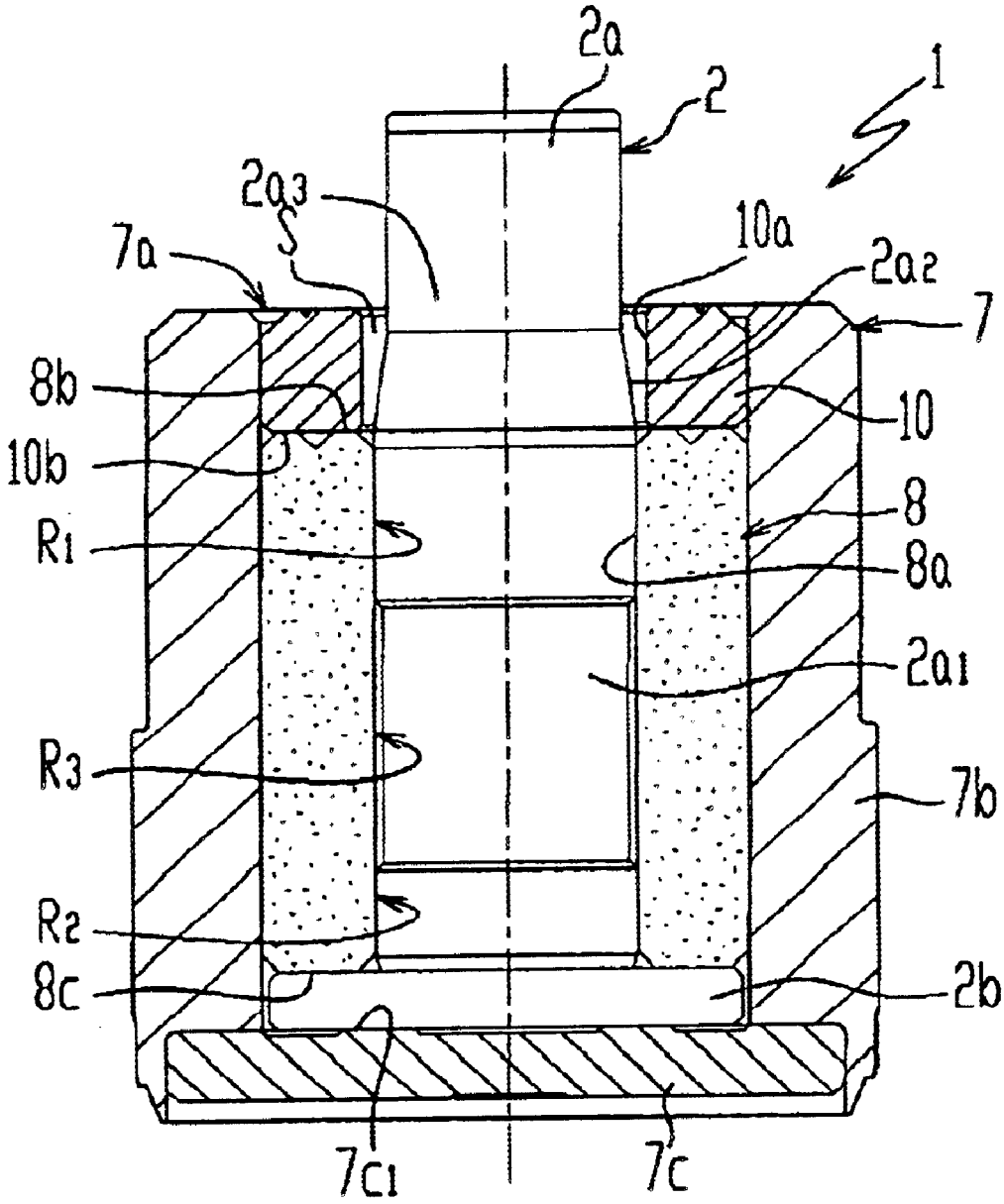
FIG. 8 is a vertical cross sectional front view showing the configuration of a hydro dynamic bearing device manufactured by the manufacturing method according to the embodiment of the present invention.

Hereinafter, preferred embodiments of the resent invention will be described with reference to the accompanying drawings. FIGS. 1 to 6 show schematic diagrams illustrating the statuses of carrying out the step of gliding in the method for manufacturing a hydro dynamic bearing device in accordance with the present invention. FIG. 8 is an enlarged cross-sectional front view showing the internal structure of a hydro dynamic bearing device.

At first, for convenience of explanation, the configuration of a hydro dynamic bearing device will he described in detail prior to the description of the statuses of carrying out the step of grinding in the manufacturing method.

As shown in FIG. 8, the hydro dynamic bearing device 1 mainly includes a closed-end cylindrical housing 7 having an opening part 7*a* in its end, a cylindrical bearing sleeve 8 fixed on the inner periphery of the housing 7, an axial member 2 arranged on the inner periphery of the bearing sleeve 8, and a sealing member 10 fixed in the opening part 7*a* of the housing 7.

The housing 7 may be one made of a soft metallic material such as brass in cylindrical form having a peripheral part 7*b* and a bottom part 7*c*. In addition, for example, a spiral hydro dynamic pressure generating groove (not shown) may be formed in the area of the bottom part 7*c* to be provided as a thrust bearing surface of the inner bottom surface 7*cl* of the bottom part 7*c*. In this embodiment, the peripheral part 7*b* and the bottom part 7*c* are provided as individual structural components in the housing 7. A lid member to be provided as the bottom part 7*c* is fixed in one of the openings of the peripheral part 7*b* by fixing with an adhesive or the like while caulking the other opening of the peripheral part 7*b*. Alternatively, the peripheral part 7*b* and the bottom part 7*c* may be integrally molded together.

The axial member 2 may be made of a metallic material such as a stainless steel. The axial member 2 includes an axial part 2*a*, and a flange part 2*b* formed integrally or separately formed on the lower end of the axial part 2*a*. Furthermore, a hollow 2*a*1 and a tapered surface 2*a*2 are formed in the outer peripheral surface of the axial part 2*a*. The tapered surface 2*a*2 has a predetermined taper angle to gradually decrease the diameter thereof from the the lower end to the upper end thereof, while the cylindrical surface 2*a*3 of the axial member 2*a* is formed immediately above the tapered surface 2*a*2 in a continuous manner.

The above bearing member 8 is formed from a porous material or the like, particularly a sintered metal mainly comprising copper. Thus, pores are formed in the bearing member 8, so that these pores can be impregnated with lubricant oil to provide an oil-containing bearing. Furthermore, on the inner peripheral surface 8*a* of the bearing member 8, upper and lower radial bearing surfaces R1 and R2 are formed. In addition, a spacing part R3 is interposed between the surfaces R1 and R2 to separate these surfaces R1, R2 in the axial direction. Each of the bearing surfaces R1, R2 has a hydro dynamic pressure generating groove with the herringbone shape (not shown). Also, the spacing part R3 faces to the hollow 2*a*1 of the axial part 2*a*, and the clearance between the spacing part R3 and the hollow 2*a*1 is set to be larger than the radial bearing clearance. Furthermore, the bottom surface 8*c* of the bearing member 8 has an area to be provided as a thrust bearing surface. In such an area, a hydro dynamic pressure generating groove (not shown) in the shape of a spiral or the like is formed.

The sealing member 10 is formed like a ring and is fixed in the inner peripheral surface of the opening part 7*a* of the housing 7 by means of press-fit and/or adhesive, or the like. In this embodiment, furthermore, the inner peripheral surface 10*a* of the sealing member 10 is formed like a cylinder and the lower end face 10*b* of the sealing member 10 abuts on the upper end face 8*b* of the bearing member 8. Furthermore, the inner peripheral surface 10*a* of the sealing member 10 faces to the tapered surface 2*a*2 of the axial part 2*a* through a predetermined clearance therebetween. Between these components facing to each other, there is formed a sealing space S. This space S is provided as a tapered space gradually expanded in the upward direction of the housing 7.

Next, the step of grinding in the method for manufacturing the above hydro dynamic bearing device 1, more specifically the step of grinding the axial member 2 which is a structural component of the hydro dynamic bearing device 1.

Figure 1:
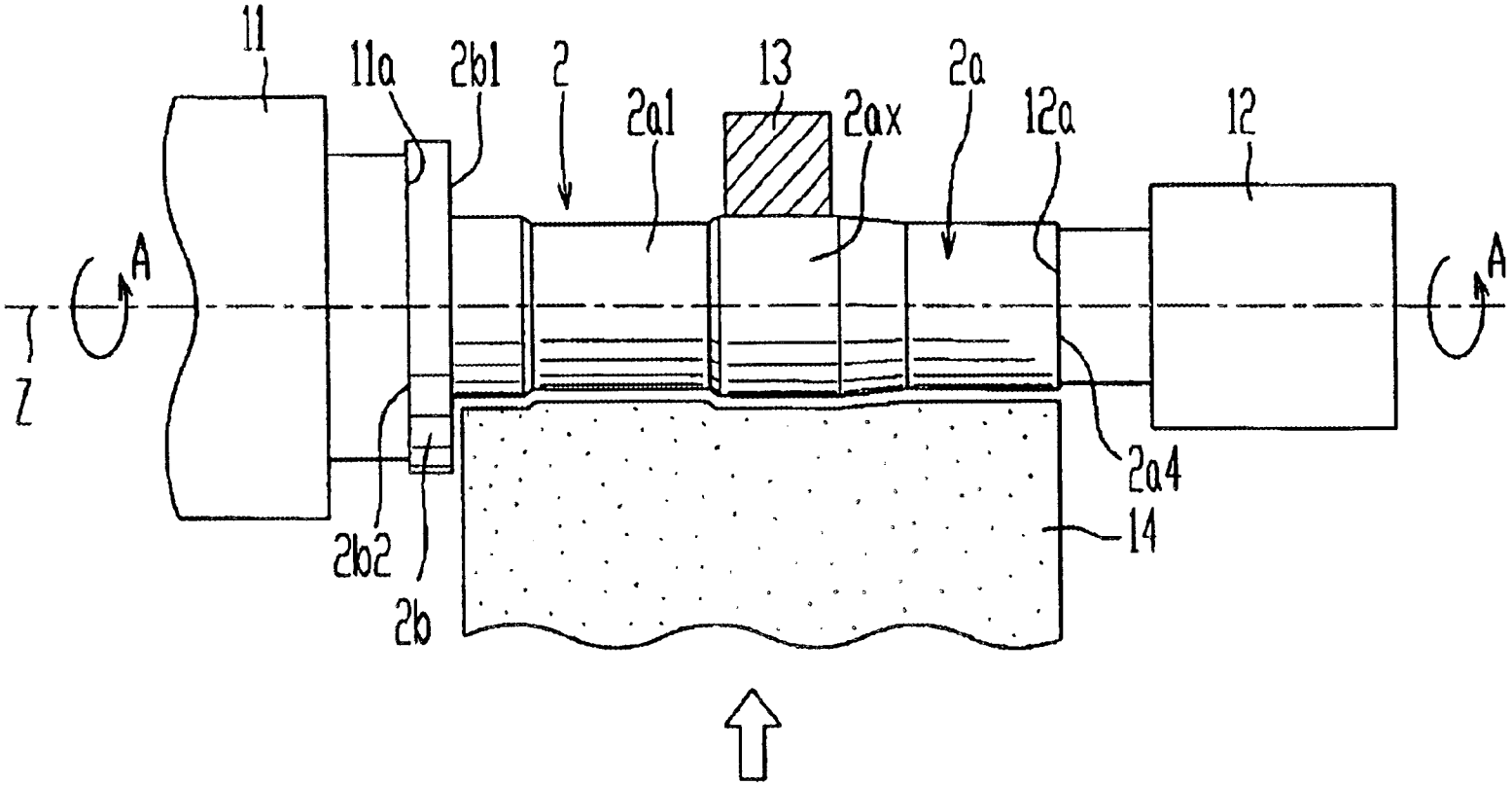
FIG. 1 is a schematic front view showing a method for manufacturing a hydro dynamic bearing device according to one of embodiments of the present invention.

In the axial member 2, as shown in FIG. 1, the proximal end face (the end face on the far side from the axial part 2*a*) 2*b*2 of the flange part 2*b* is brought into contact with the distal end face (hereinafter, referred to as a first distal end face) 11*a* of the backing plate 11 provided as one of the plate members in a face-contact manner. In the axial member 2, furthermore, the distal end face 2*a*4 of the axial part 2*a* is brought into contact with the distal end face (hereinafter, referred to as a second distal end face) 12*a* of the pressure plate 12 provided as the other of the plate members in a face-contact manner. In this case, the backing plate 11 is provided as a cylindrical body. The first distal end face 11*a* of the backing plate 11 is formed as a flat surface outlined in a circular form. Likewise, the above pressure plate 12 is also in the shape of a cylinder and its second distal end face 12*a* is formed as a flat surface outlined in a circular form.

Furthermore, at the time of the grinding, the axial member 2 rotate around the axle center Z together with the backing plate 11 and the pressure plate 12 as indicated by the arrow A in the figure such that the axial member 2 is being sandwiched between the backing plate 11 and the pressure plate 12. In this case, the rotary driving force around the axle center Z is provided from the backing plate 11 and/or the pressure plate 12 to the axial member 2, and also the holding power (press force) around the axle center Z from the pressure plate 12.

Under such conditions, in the axial member 2, the outer peripheral surface of the axial part 2*a* (i.e., the outer peripheral surface of a large-diameter non-tapered part 2*ax* which is formed adjacent to the hollow 2*a*1 almost on the middle of the axial part 2*a* in the axial direction) is supported by the supporting member (shoe) 13. The grindstone 14 having a grinding surface extending almost over the axial length of the axial part 2*a* is brought into press contact with almost the whole length of the outer peripheral surface of the axial part 2*a* from the opposite side of the axle center Z with respect to the supporting member 13.

Therefore, a rotary motion at a sufficient circumferential speed (e.g., about 1500 rpm) is imparted to the axial member 2*a*, while the outer peripheral surface of the axial part 2*a* is supported by the supporting member 13 without causing undesired centrifugal whirling, allowing the grinding of the outer peripheral surface with the grindstone 14 with high accuracy.

Figure 2:
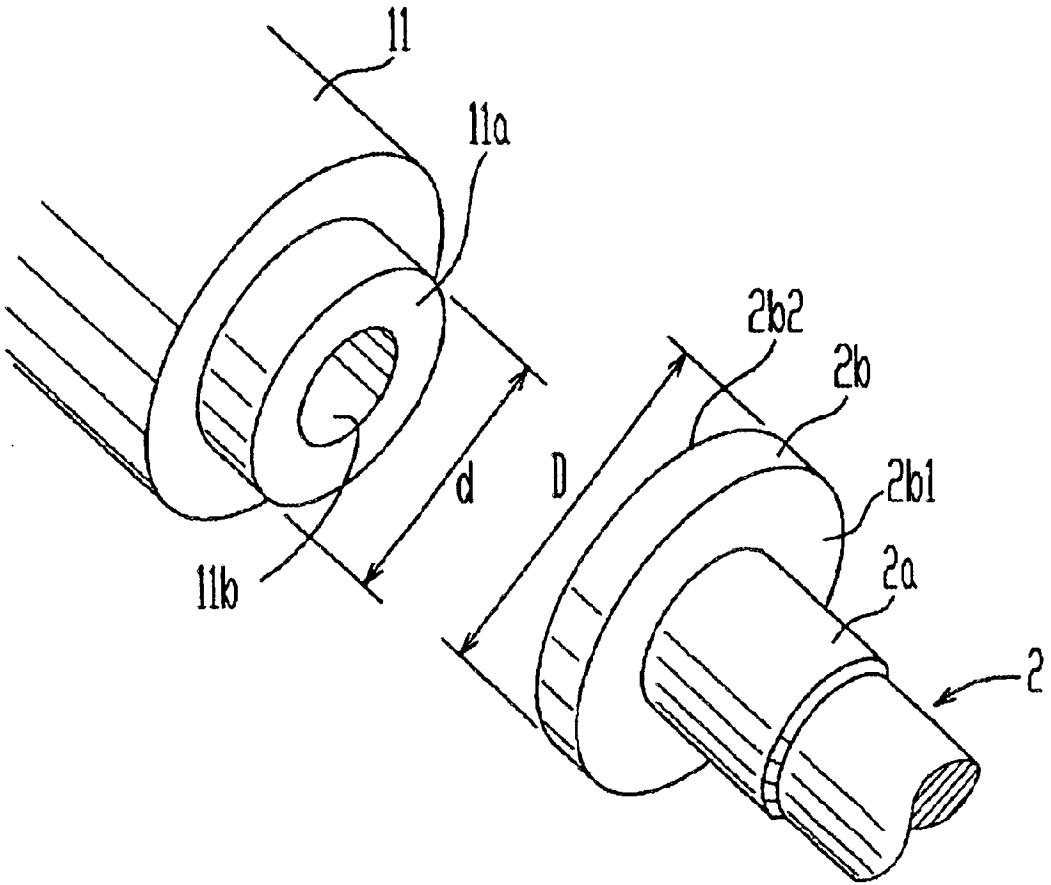
FIG. 2 is a schematic perspective view showing the configuration of the structural components for illustrating the method for manufacturing a hydro dynamic bearing device according to one of embodiments of the present invention.

In this case, as shown in FIG. 2, the outer diameter d of the first distal end face 11*a* of the backing plate 11 is smaller than the outer diameter D of the proximal end face 2*b*2 of the flange part 2*b* formed on the axial member 2. In addition, a circular roll-off part (a recessed part) 11*b* is formed in the predetermined area of the rotational center of the first distal end face 11*a*.

Figure 3:
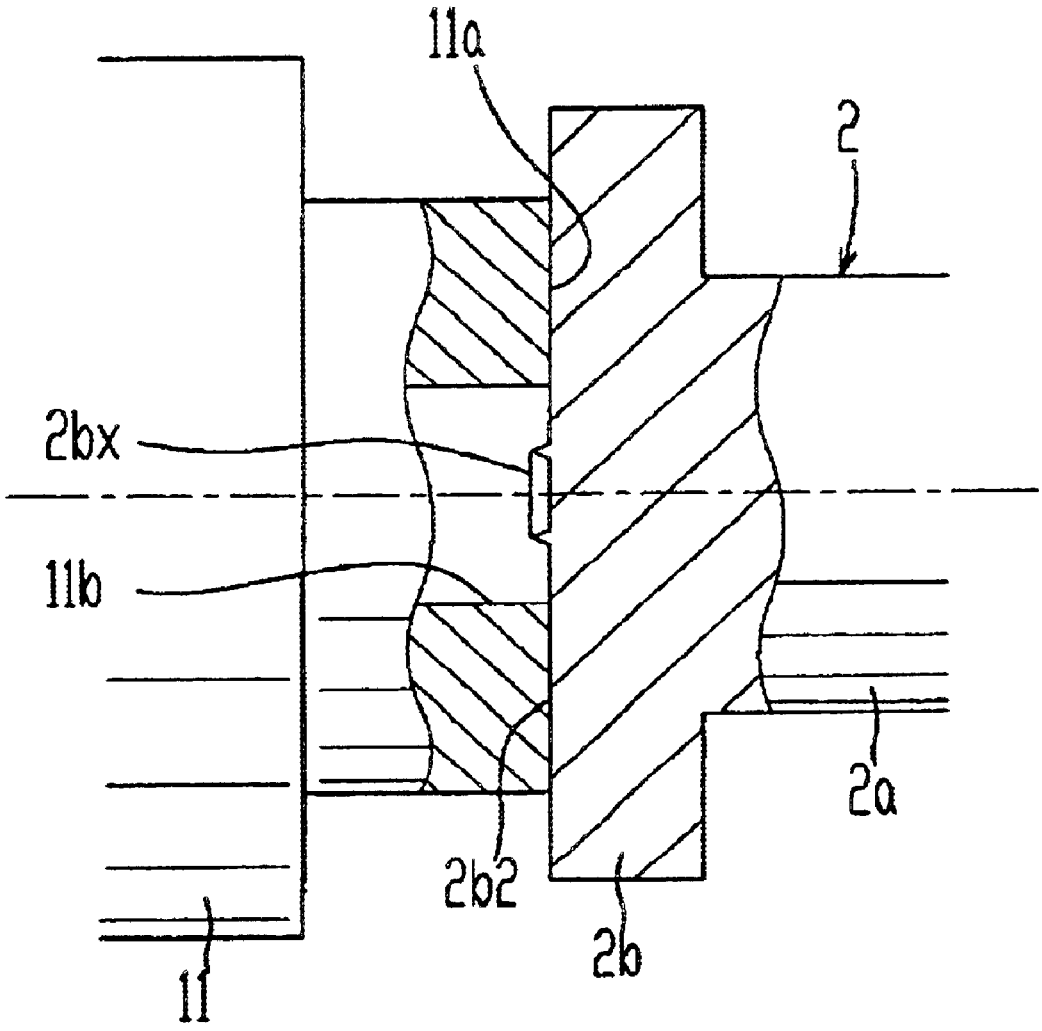
FIG. 3 is a partially enlarged front view showing a main part of the structural components for illustrating the method for manufacturing a hydro dynamic bearing device according to one of embodiments of the present invention.

Therefore, at the time of grinding the axial member 2 prior to such a step of grinding, a protruded part 2*bx* is formed on the center of the proximal end face 2*b*2 as shown in FIG. 3 due to a low circumferential speed of the rotational center of the proximal end face 2*b*2 of the flange part 2*b*. The protruded part 2*bx* is to be housed in the inner space of the roll-off part 11*b*, so that an appropriate face-contacting condition between the proximal end face 2*b*2 of the flange part 2*b* and the first distal end face 11*a* of the backing plate 11 can be secured. By the way, just as with the above description, a roll-off part may also be formed in the second distal end face 12*a* of the pressure plate 12.

Figure 4:
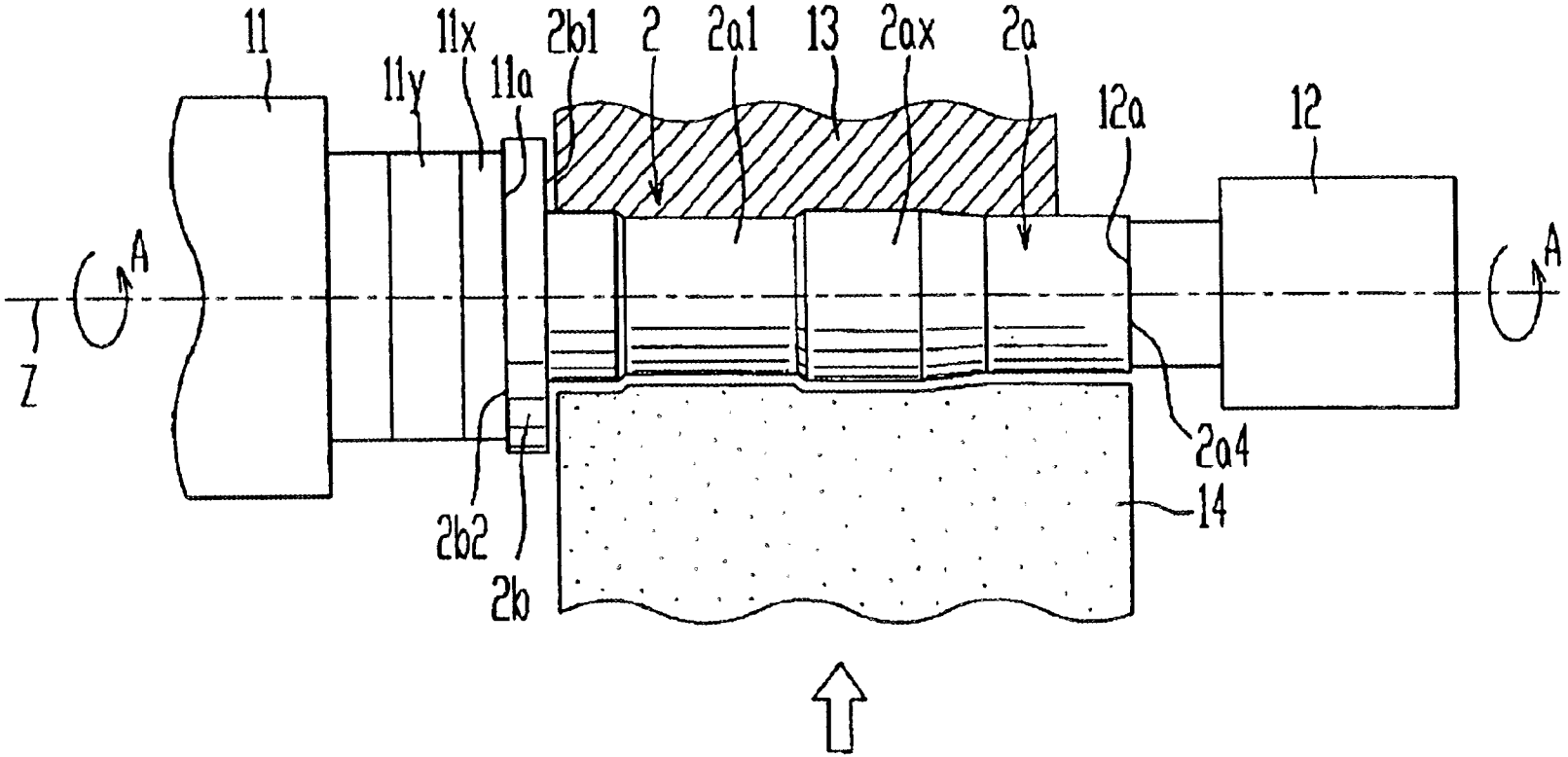
FIG. 4 is a schematic front view showing a method for manufacturing a hydro dynamic bearing device according to a second embodiment of the present invention.

FIG. 4 is a schematic diagram for illustrating the state of grinding operation when the supporting member 13 and the backing plate 11 of the grinding apparatus to be used in the step of grinding are different from those described above. In this figure, the same structural components as those illustrated in FIGS. 1 to 3 are provided with the same reference numerals and the detailed descriptions thereof will be omitted from the following description.

As shown in FIG. 4, the length of the supporting member 13 in the direction parallel to the axle center Z thereof is defined to two third or more, for example about three fourth with respect to the axial length of the axial part 2*a* of the axial member 2. Therefore, the supporting member 13 is brought into contact with two third or more area of the outer peripheral surface of the axial part 2*a* in the direction of the axle center. The supporting member 13 is not necessarily in contact with the outer peripheral surface of the axial part 2*a* with the whole area of the tip of the supporting member 13. Alternatively, the supporting member 13 may have several parts for partially contacting the outer peripheral surface of the axial part 2*a*. In this case, however, the contacting area from the contacting part of one end of the supporting member 13 to the contacting part of the other end thereof should be two third or more of the outer peripheral surface of the axial part 2*a* in the direction of the axle center.

Furthermore, as shown in the figure, a metallic plate 11*x* provided as the contacting part to face contact with the proximal end face 2*b*2 of the flange part 2*b* is elastically retained on the base part of the backing plate 11 through an elastic member 11*y* made of rubber, resin, or the like. Therefore, the plate 11*x* is allowed to keep its state of being closely contact with the proximal end face 2*b*2 of the flange part 2*b* by an appropriate elastic deformation of the elastic member 11*y*, so that a state of supporting with stable face-contact can be attained.

Figure 7:
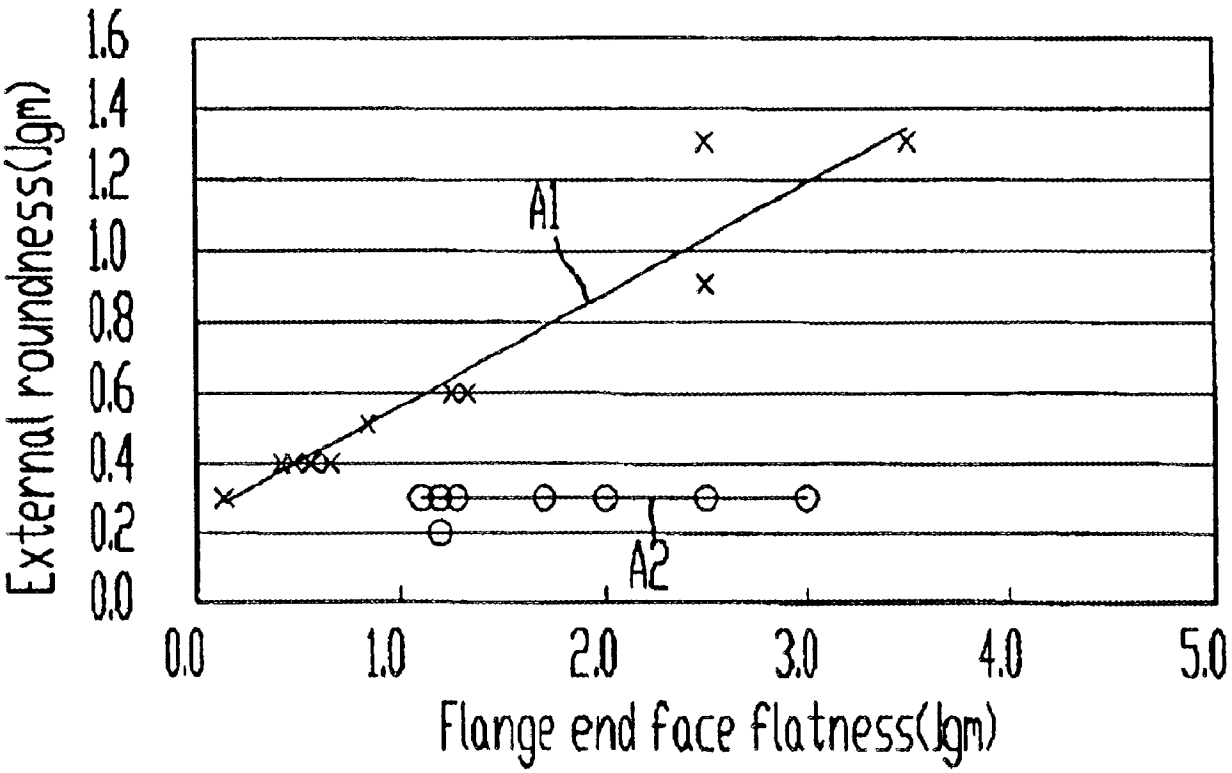
FIG. 7 is a graphic diagram showing the accuracy of the axial member prepared by the manufacturing method according to the embodiment of the present invention.

FIG. 7 is a graphical representation of the results of comparing between the grinding in the state shown in FIG. 1 and the grinding in the state shown in FIG. 4, which are described above, with respect to the roundness (μm) of the outer peripheral surface of the axial part 2*a* after the grinding for the amount of deviation from perfect flatness (μm) of the proximal end face 2*b*2 of the flange part 2*b*. In this experiment, by the way, the test work (the axial member 2) used is made of stainless steel (HV580) and has a total length of 18 mm, an axial-part diameter of 4.5 mm, a flange-part diameter of 7 mm, and a flange-part thickness of 1.5 mm. The grindstone used is an aluminum-based grindstone. In the graph shown in the figure, a characteristic line represented by the mark "X (cross)" and the symbol "A1" is obtained from the results under the state of grinding operation described above shown in FIG. 1. In addition, a characteristic line represented by the mark "O (circle)" and the symbol "A2" is obtained from the results under the state of grinding operation shown in FIG. 4. In this case, the term "flatness" means the vertical interval between the most protruded part and the most repressed part of the measuring surface. Furthermore, the term "roundness" means the amount of deviation from perfect geometric circle of the outer peripheral surface of the axial part 2*a*.

According to the graph, the elastic member 11*y* is mounted on the backing plate 11 as shown in FIG. 4 and two third or more area of the outer peripheral surface of the axial part 2*a* is supported by the supporting member 13 in the direction of the axle center to make difficult to be influenced by the flatness of the proximal end face 2*b*2 of the flange part 2*b*. Thus, rattle (oscillation) is hardly generated in the radial direction of the axial member 2. Consequently, it is understood that the outer peripheral surface of the axial part 2*a* can be ground with high precision. In other word, this procedure allows the roundness of the axial part 2*a* to be at least 0.5 μm or less when the flatness of the proximal end face 2b2 of the flange part 2b is 3 μm or less. On the other hand, one fifth or less of the outer peripheral surface of the axial part 2a may be supported by the supporting member 13 without placing the elastic member as shown in FIG. 1. In this case, the roundness of the outer peripheral surface of the axial part 2a is about 1 μm or more when the flatness of the proximal end face 2b2 of the flange part 2b is 2.5 μm or more. In this case, for obtaining a desired roundness with high precision, the flatness of the proximal end face 2b2 of the flange part 2b should be 1.0 μm or less.

On the other hand, the grinding of the distal end face 2b1 of the flange part 2b (the end face facing to the axial part 2a) and the proximal end face 2b2 thereof in the axial member 2 is performed as allows.

Figure 5:
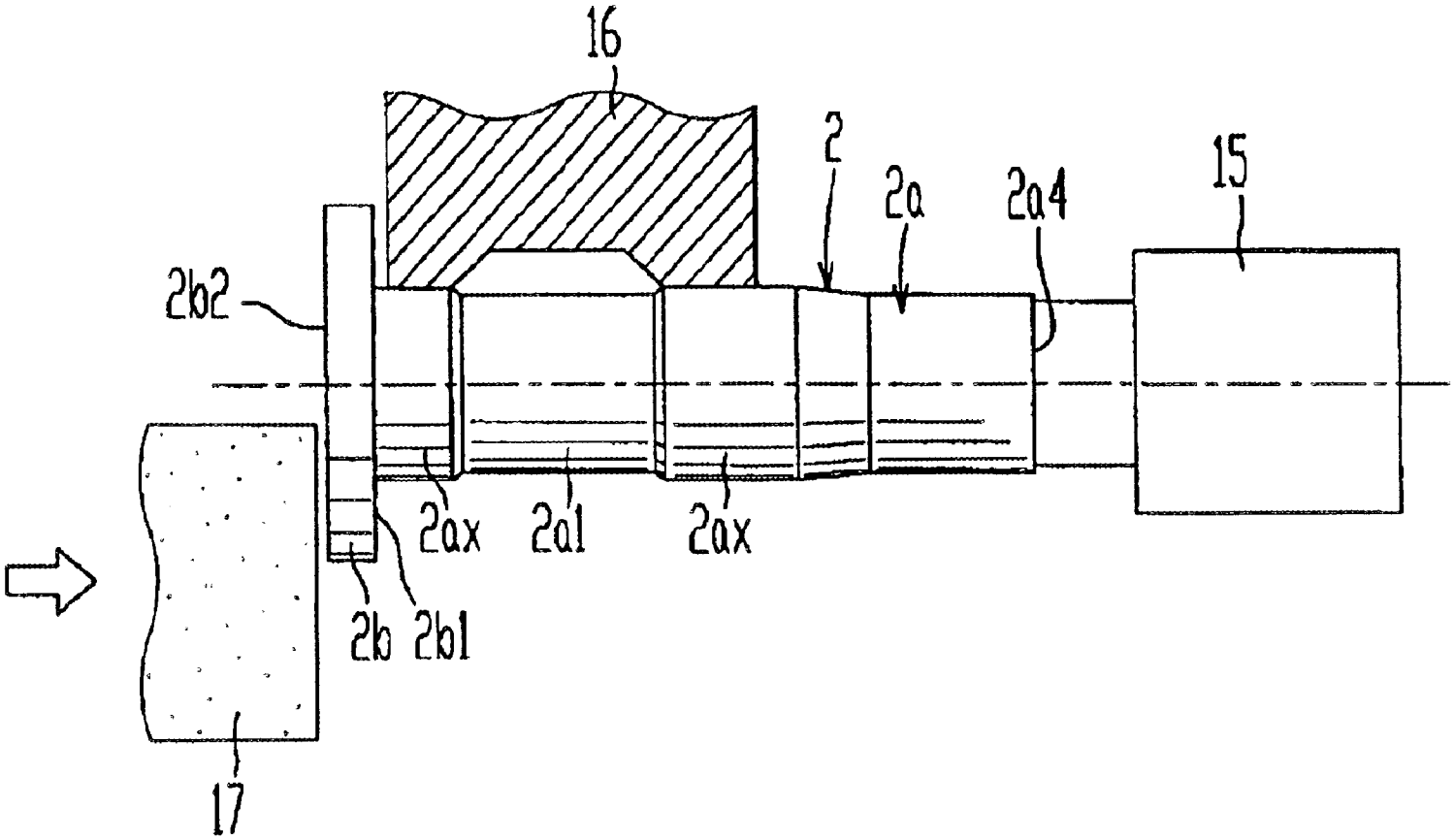
FIG. 5 is a schematic front view showing a method for manufacturing a hydro dynamic bearing device according to a third embodiment of the present invention.

At first, as shown in FIG. 5, the distal end face 2a4 of the axial part 2a formed on the axial member 2 is supported by a tip-supporting plate 15, while a rotational movement is imparted to the axial member 2 by interlocking with a rotary roll (not shown) being contact with the outer peripheral surface of the axial part 2a. In addition, the outer peripheral surface of the axial part 2a (i.e., each of large-diameter non-tapered parts 2ax, 2ax formed adjacent to the opposite sides of the hollow 2a1) is supported by a supporting member (shoe) 16 while press-contacting the proximal end face 2b2 of the flange part 2b with a grindstone 17 to perform the grinding operation.

Figure 6:
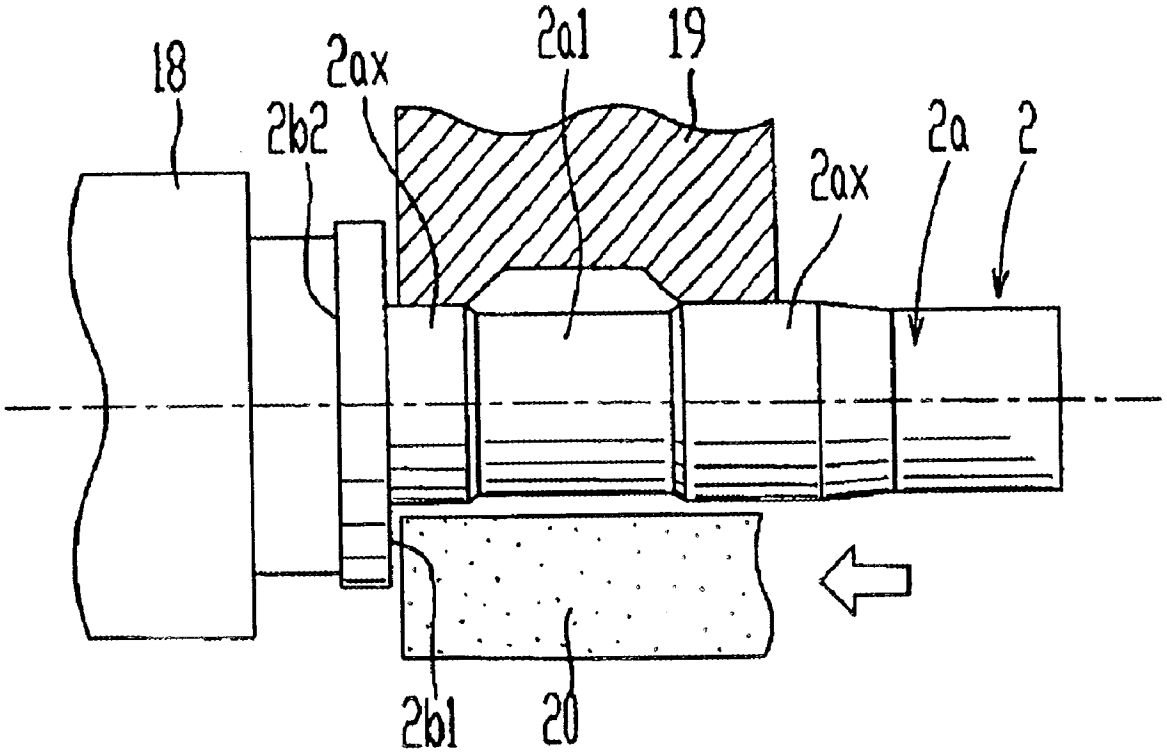
FIG. 6 is a schematic front view showing a method for manufacturing a hydro dynamic bearing device according to a fourth embodiment of the present invention.

Therefore, after completing the grinding operation on the proximal end face 2b2 of the flange part 2b, as shown in FIG. 6, the proximal end face 2b2 of the flange part 2b is retained by a proximal-end retaining plate 18 while a rotational movement is imparted to the axial member 2 by interlocking with a rotary roll (not shown) being contact with the outer peripheral surface of the axial part 2a just as with the above description. In addition, the outer peripheral surface of the axial part 2a is supported by a supporting member (shoe) 19 while press-contacting the distal end face 2b1 of the flange part 2b with a grindstone 20 to perform the grinding operation just as with the above description.

After completing each of the above steps, the axial member 2 is subjected to finishing and is then combined with other structural components, followed by performing each of predetermined treatments such as the steps of greasing and sampling to obtain a hydro dynamic bearing device 1 as a finished product as described above with reference to FIG. 8. Furthermore, the hydro dynamic bearing device 1 as such a finished product is used as one of structural components that made up a motor.

Figure 9:
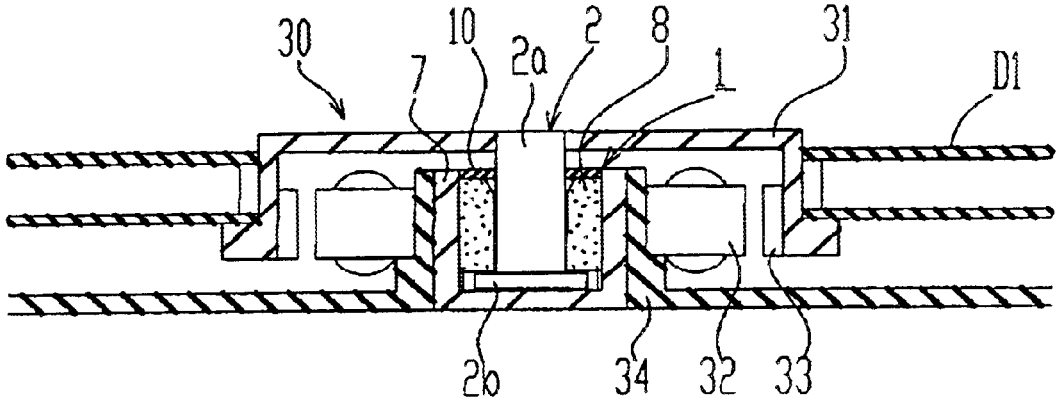
FIG. 9 is a schematic vertical cross sectional front view showing a state in which the hydro dynamic bearing device manufactured by the manufacturing method according to the embodiment of the present invention is incorporated in a spindle motor.
Figure 10:
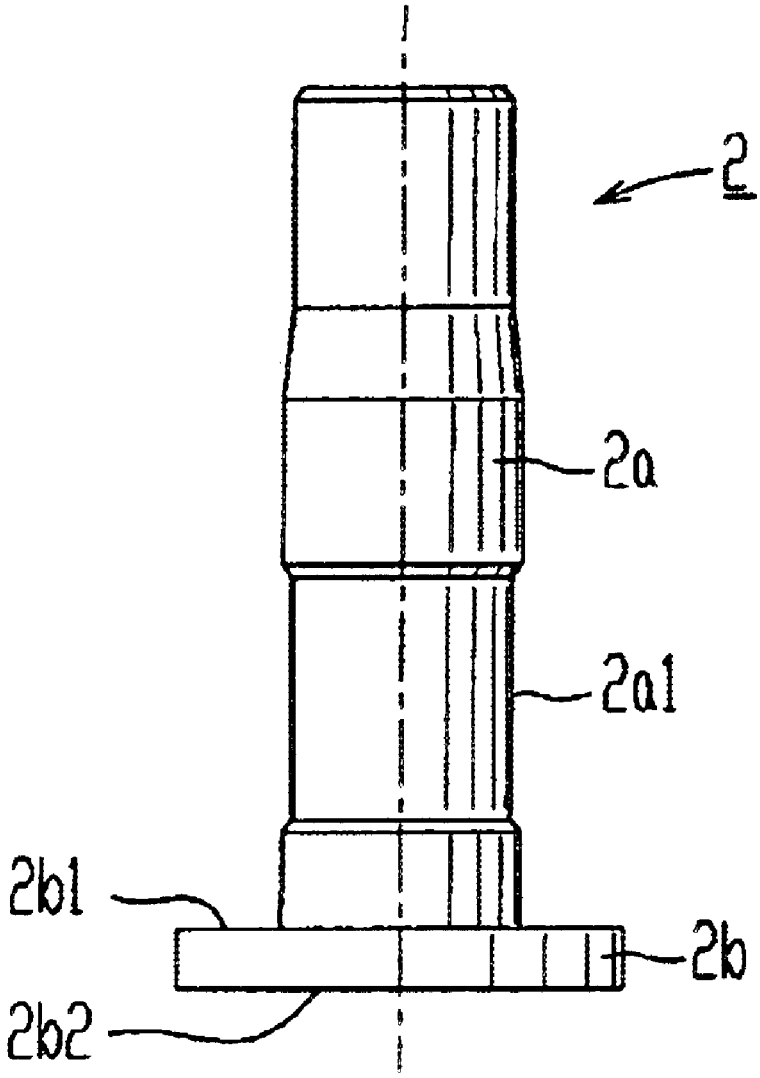
FIG. 10 is a front view showing an axial member alone prepared by the manufacturing method according to the embodiment of the present invention.
Figure 11:
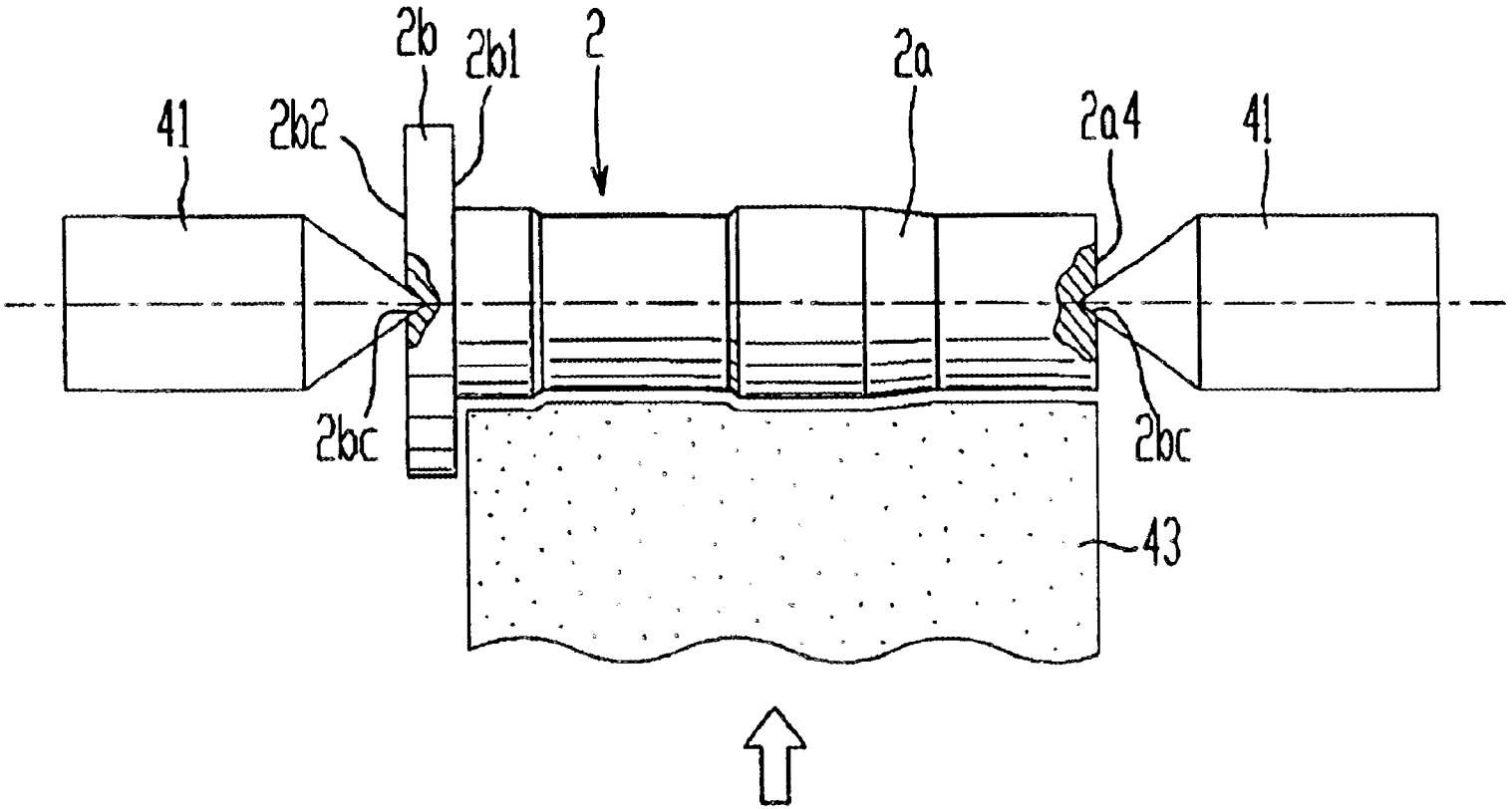
FIG. 11 (PRIOR ART)
FIG. 11 is a schematic front view showing an exemplified conventional method for manufacturing a hydro dynamic bearing device.

That is, a spindle motor 30 for an information technology device as illustrated in FIG. 9 is used in a disk driving device such as a hard disk drive (HDD). The spindle motor 30 has a disk hub 31 mounted on the axial member 2 of the above hydro dynamic bearing device 1, and a motor stator 32 and a motor rotor 33 facing to each other through a clearance in the radial direction or the like. The stator 32 is installed on the outer periphery of a casing 34 and the rotor 33 is installed on the inner periphery of the disk hub 31. A housing 7 for the hydro dynamic bearing device 1 is attached on the inner periphery of the casing 34. In the disk hub 31, one or more magnetic disks D1 or the like are held. Then, by applying power to the stator 32, an exciting magnetic force between the stator 32 and the rotor 33 imparts a rotary motion to the rotor 33, allowing the disk hub 31 and the axial member 2 to integrally rotate together.

As described above, according to the method for manufacturing a hydro dynamic bearing device of the present invention, the outer peripheral surface of the axial part of the axial member is ground by a grindstone while the axial member is supporting by a pair of plate members from the opposite ends of the axial member in the axial direction in a face contact manner to allow the rotation of the axial member around its axle center and the outer peripheral surface of the axial part of the axial member is supported by the supporting member. Therefore, comparing with the conventional center support, the contact-surface area between both ends of the axial member and both plate members becomes broaden, while a sliding between both the end faces and both plate members is hardly occurred. Thus, the axial member can be interposed between both plates with a large holding power, imparting a rotary motion to the axial member. Therefore, the axial member allows a sufficient increase in the circumferential speed when the axial member rotates around the axle center, so that the grinding efficiency and the working efficiency can be improved. Furthermore, at the time of rotating the axial member, the centrifugal whirling hardly occurs, so that it becomes possible to grind the outer peripheral surface of the axial part with high precision.

Furthermore, at least for the plate member to be face contact with the flange part of the axial member, the roll-off part may be formed on the predetermined area of the rotational center of the contact surface thereof. In this case, even though a protruded part formed in the vicinity of the rotational center of the end face (particularly, the end face of the flange part) of the axial member at the time of grinding, the protruded part escapes into the inner space of the roll-off part to prevent it from contacting with the plate member, allowing to ensure an appropriate face-contacting state.

Furthermore, the outer peripheral diameter d of the contact face of the plate member may be smaller than the outer peripheral diameter D of the flange part. In this case, comparing with the case in which the diameter of the contact surface of the plate member is almost equal to the flange diameter, sliding hardly occurs on the contact surface because of enlarging the holding pressure to be acted on the unit aria of the contact surface. In addition, the difference from the supporting state of the end face on the axial part side decreases. Therefore, it becomes possible to support the opposite ends of the axial member while keeping good balance and stability.

Furthermore, the contacting part of the plate member to the flange part may be elastically supported by the elastic member to allow an appropriate elastic deformation of the elastic member. Therefore, the contacting part of the plate member is brought into contact with the whole area of the contacting part of the flange part in a face-contact manner without any clearance. The face-contacting support state to the flange part becomes stable, so that it becomes possible to grind the outer peripheral surface of the axial part with high precision.

Furthermore, the outer peripheral surface of the axial member may be configured such that two third or more of the outer peripheral surface of the axial member is supported by the supporting member in the direction of the axle center. Therefore, the press force from the grindstone can be uniformly received by the supporting member extensively in the direction of the axle center. The outer peripheral surface of the axial part can be ground with high precision while rattle and oscillation of the axial part hardly occur.

Furthermore, as described above, , when the step of grinding the end face of the flange part on the axial part side and the other end face of the flange part on the far side from the axial part is included in addition to the step of grinding the outer peripheral surface of the axial member, the grinding of the end face on the far side from the axial part may be performed prior to the grinding of the end face on the axial part. In this case, the end face of the flange part on the far side from the axial part can be ground with high precision, followed by grinding the end face of the flange part on the axial part side while supporting the finished end face with the supporting member. Consequently, it is possible to grind both end faces of the flange part on the axial part side and the far side from the axial part with high great precision.

What is claimed is:

1. A method for manufacturing a hydro dynamic bearing device including an axial member having a flange part on one end of an axial part thereof, a radial bearing part for supporting the axial part in a non-contact manner in a radial direction by a hydro dynamic pressure action of a fluid generated in a radial bearing clearance, and a thrust bearing part for supporting the flange part in a non-contact manner in a thrust direction by a hydro dynamic pressure action of a fluid generated in a thrust bearing clearance, the method comprising the steps of:

supporting the axial member at both ends in an axial direction thereof with a pair of plate members in a face-contact manner;

rotating the axial member around its axial center; and grinding an outer peripheral surface of the axial part of the axial member on a grindstone while supporting the outer peripheral surface of the axial part with a supporting member.

2. A method for manufacturing a hydro dynamic bearing device as described in claim 1, wherein the plate member contacting with at least the flange part of the axial member in a face-contact manner has a roll-off part in a predetermined area of a rotational center of the contact surface of the plate member.

3. A method for manufacturing a hydro dynamic bearing device as described in claim 1, wherein an outer diameter d of the contact surface of the plate member to be brought into contact with the flange part in a face-contact manner is set to be smaller than an outer diameter D of the flange part.

4. A method for manufacturing a hydro dynamic bearing device as described in claim 2, wherein an outer diameter d of the contact surface of the plate member to be brought into contact with the flange part in a face-contact manner is set to be smaller than an outer diameter D of the flange part.

5. A method for manufacturing a hydro dynamic bearing device as described in claim 1, wherein a contact part of the plate member to the flange part is elastically supported by a elastic member.

6. A method for manufacturing a hydro dynamic bearing device as described in claim 2, wherein a contact part of the plate member to the flange part is elastically supported by a elastic member.

7. A method for manufacturing a hydro dynamic bearing device as described in claim 3, wherein a contact part of the plate member to the flange part is elastically supported by a elastic member.

8. A method for manufacturing a hydro dynamic bearing device as described in claim 1, wherein the supporting member supports two thirds or more of the outer peripheral surface of the axial part of the axial member in the axial direction.

9. A method for manufacturing a hydro dynamic bearing device as described in claim 2, wherein the supporting member supports two thirds or more of the outer peripheral surface of the axial part of the axial member in the axial direction.

10. A method for manufacturing a hydro dynamic bearing device as described in claim 3, wherein the supporting member supports two thirds or more of the outer peripheral surface of the axial part of the axial member in the axial direction.

11. A method for manufacturing a hydro dynamic bearing device as described in claim 5, wherein the supporting member supports two thirds or more of the outer peripheral surface of the axial part of the axial member in the axial direction.

12. A method for manufacturing a hydro dynamic bearing device as claimed in claim 1, further comprising the step of grinding one end face of the flange part on the axial part side and the other end face of the flange part on the far side from the axial part, wherein the end face on the far side from the axial part is ground in advance of grinding the end face on the axial part side.

13. A method for manufacturing a hydro dynamic bearing device as claimed in claim 2, further comprising the step of grinding one end face of the flange part on the axial part side and the other end face of the flange part on the far side from the axial part, wherein the end face on the far side from the axial part is ground in advance of grinding the end face on the axial part side.

14. A method for manufacturing a hydro dynamic bearing device as claimed in claim 3, further comprising the step of grinding one end face of the flange part on the axial part side and the other end face of the flange part on the far side from the axial part, wherein the end face on the far side from the axial part is ground in advance of grinding the end face on the axial part side.

15. A method for manufacturing a hydro dynamic bearing device as claimed in claim 5, further comprising the step of grinding one end face of the flange part on the axial part side and the other end face of the flange part on the far side from the axial part, wherein the end face on the far side from the axial part is ground in advance of grinding the end face on the axial part side.

16. A method for manufacturing a hydro dynamic bearing device as claimed in claim 8, further comprising the step grinding one end face of the flange part on the axial part side and the other end face flange part on the far side from the axial part, wherein the end face on the far side from the axial part is ground in advance of grinding the end face on the axial part side.

* * * * *